US012421063B2

(12) United States Patent
Kishimoto et al.

(10) Patent No.: US 12,421,063 B2
(45) Date of Patent: Sep. 23, 2025

(54) SHEET CONVEYING APPARATUS

(71) Applicant: KYOCERA Document Solutions Inc., Osaka (JP)

(72) Inventors: Tadahisa Kishimoto, Osaka (JP); Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/563,108

(22) PCT Filed: Jun. 16, 2023

(86) PCT No.: PCT/JP2023/022445

§ 371 (c)(1),
(2) Date: Nov. 21, 2023

(87) PCT Pub. No.: WO2023/248950

PCT Pub. Date: Dec. 28, 2023

(65) Prior Publication Data

US 2025/0074729 A1 Mar. 6, 2025

(30) Foreign Application Priority Data

Jun. 24, 2022 (JP) ..... 2022-101716

(51) Int. Cl.
*B65H 5/06* (2006.01)
*B65H 5/38* (2006.01)

(52) U.S. Cl.
CPC ..... *B65H 5/06* (2013.01); *B65H 5/38* (2013.01); *B65H 2402/10* (2013.01)

(58) Field of Classification Search
CPC . G03G 15/00; B65H 5/06; B65H 5/38; B65H 2402/10
See application file for complete search history.

(56) References Cited

U.S. PATENT DOCUMENTS

2007/0048010 A1* 3/2007 Nakano ..... B65H 5/38 399/121
2009/0185840 A1 7/2009 Inoue et al. ..... 399/331

FOREIGN PATENT DOCUMENTS

JP 05139574 A * 6/1993
JP 2009-169256 A 7/2009
JP 2017210334 A * 11/2017

* cited by examiner

*Primary Examiner* — Leslie A Nicholson, III
(74) *Attorney, Agent, or Firm* — Stein IP LLC

(57) ABSTRACT

The coupling unit (UC) includes a shaft, a shaft holder and a shaft fitting plate. The shaft holder includes a first coupling portion, and a first unit includes a second coupling portion. When the first unit is mounted in an apparatus body and coupled to a second unit, first, with an other-end portion (UC2) swung upward, the first unit is mounted in the apparatus body and then, with the other-end portion (UC2) swung downward, the first coupling portion is coupled to the second coupling portion.

8 Claims, 15 Drawing Sheets

SHEET CONVEYING APPARATUS

CROSS-REFERENCE TO RELATED APPLICATIONS

This application is a national stage of International Application No. PCT/JP2023/022445, filed Jun. 16, 2023, which claims the benefit of Japanese Application No. 2022-101716, filed Jun. 24, 2022, in the Japanese Patent Office, the disclosures of which are incorporated herein by reference.

TECHNICAL FIELD

The present invention relates to a sheet conveying apparatus.

BACKGROUND ART

Sheet conveying apparatuses for conveying sheets are known. As sheet conveying apparatuses, for example, image forming apparatuses are known. An image forming apparatus conveys a sheet and prints an image on the sheet being conveyed (see, for example, Patent Document 1 identified below).

CITATION LIST

Patent Literature

Patent Document 1: JP-A-2009-169256

SUMMARY OF INVENTION

Technical Problem

For example, a sheet conveying apparatus includes a plurality of units that each convey a sheet. Those units are coupled together. Moreover, the plurality of units can each be mounted in and dismounted from the apparatus body unit by unit. With this construction, of the plurality of units constituting the sheet conveying apparatus, only a particular one can be replaced, dismounted for checks, or otherwise handled.

When a unit is mounted in or dismounted from the body of the sheet conveying apparatus, units need to be coupled together or decoupled from each other inside the body of the sheet conveying apparatus. If the coupling or decoupling between units requires complicated manipulation, their mounting and dismounting with respect to the apparatus body is troublesome.

Against the background described above, an object of the present invention is to provide a sheet conveying apparatus that facilitates the mounting and dismounting of a unit with respect to an apparatus body.

Solution to Problem

To achieve the above object, according to one aspect of the present invention, a sheet conveying apparatus includes: an apparatus body having a sheet reception port and a sheet discharge port; a first unit mounted in the apparatus body, the first unit receiving a sheet conveyed from the sheet reception port and conveying the sheet downstream; a second unit mounted in the apparatus body, downstream of the first unit with respect to the sheet conveyance direction, the second unit discharging the sheet from the sheet discharge port; and a coupling unit having a one-end portion pivoted on the second unit and an other-end portion swingable about a pivoted part of the one-end portion and decouplably coupled to the first unit, the coupling unit conveying the sheet from the first unit to the second unit. The coupling unit includes: a shaft rotatably arranged on the other-end portion; a shaft holder supporting an end part of the shaft along the axial direction; and a shaft fitting plate having a fitting hole to which the shaft is fitted. The shaft holder includes: a holder body rotatably supported in the fitting hole, the holder body being in a cylindrical shape; and a first coupling portion protruding from the holder body outward along the axial direction. The first unit includes a second coupling portion arranged outward of the shaft fitting plate along the axial direction. The first unit is mountable in the apparatus body from upstream of the second unit with respect to the sheet conveyance direction. When the first unit is mounted in the apparatus body and coupled to the second unit, first, with the other-end portion swung upward, the first unit is mounted in the apparatus body and then, with the other-end portion swung downward, the first unit is coupled to the second unit.

Advantageous Effects of Invention

With a construction according to the present invention, it is possible to facilitate the mounting and dismounting of a unit with respect to an apparatus body.

DESCRIPTION OF EMBODIMENTS

A sheet conveying apparatus according to one embodiment of the present invention will be described below. The sheet conveying apparatus according to this embodiment is a post-processing apparatus that is attached to an image forming apparatus.

<Outline of an Image Formation System>

Figure 1:
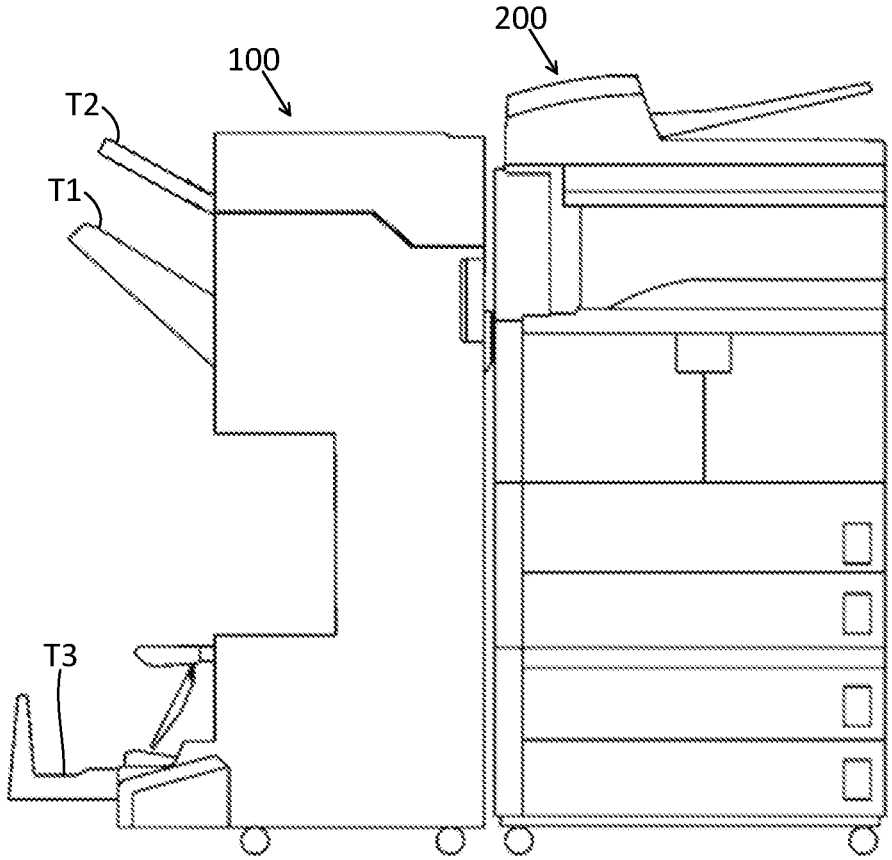
FIG. 1 is a schematic diagram of an image formation system including a post-processing apparatus according to one embodiment.

As shown in FIG. 1, the post-processing apparatus 100 (corresponding to a "sheet conveying apparatus") along with an image forming apparatus 200 constitutes an image formation system. The image forming apparatus 200 performs printing. The image forming apparatus 200 includes an image forming section (not illustrated). The image forming section forms an image on a sheet. The image forming section can employ any printing method, of which examples include an electrophotographic method and an inkjet method. The sheet used in the printing by the image forming apparatus 200 is, for example, a sheet of paper.

The image forming apparatus 200 conveys a sheet and prints an image on the sheet being conveyed. The image forming apparatus 200 also conveys the printed sheet.

The post-processing apparatus 100 is coupled to the image forming apparatus 200. The post-processing apparatus 100 can be attached to and detached from the image forming apparatus 200. The post-processing apparatus 100 receives a printed sheet from the image forming apparatus 200. That is, the post-processing apparatus 100 is arranged downstream of the image forming apparatus 200 with respect to the sheet conveyance direction.

The post-processing apparatus 100 conveys the printed sheet and performs post-processing, such as punching, stapling, and folding, on the sheet. The post-processing apparatus 100 then discharges the sheet.

The post-processing apparatus 100 performs post-processing according to the settings for a job made by a user. Depending on the settings for a job, the post-processing apparatus 100 may discharge a printed sheet without performing any post-processing on it.

The post-processing apparatus 100 may be configured to be usable on its own, without being coupled to the image forming apparatus 200. In that case, for example, the post-processing apparatus 100 is provided with a set tray. The post-processing apparatus 100 can then automatically take in a sheet placed on the set tray and perform post-processing on it.

Instead of the post-processing apparatus 100, a sheet conveying apparatus that only has a function of conveying a sheet received from the image forming apparatus 200 and then discharging the sheet may be coupled to the image forming apparatus 200.

Note that FIG. 1 is a diagram schematically showing the post-processing apparatus 100 as seen from in front. In the following description, "left" and "right" refer to the corresponding sides with respect to the apparatus as seen from in front.

<Construction of the Post-Processing Apparatus>

Figure 2:
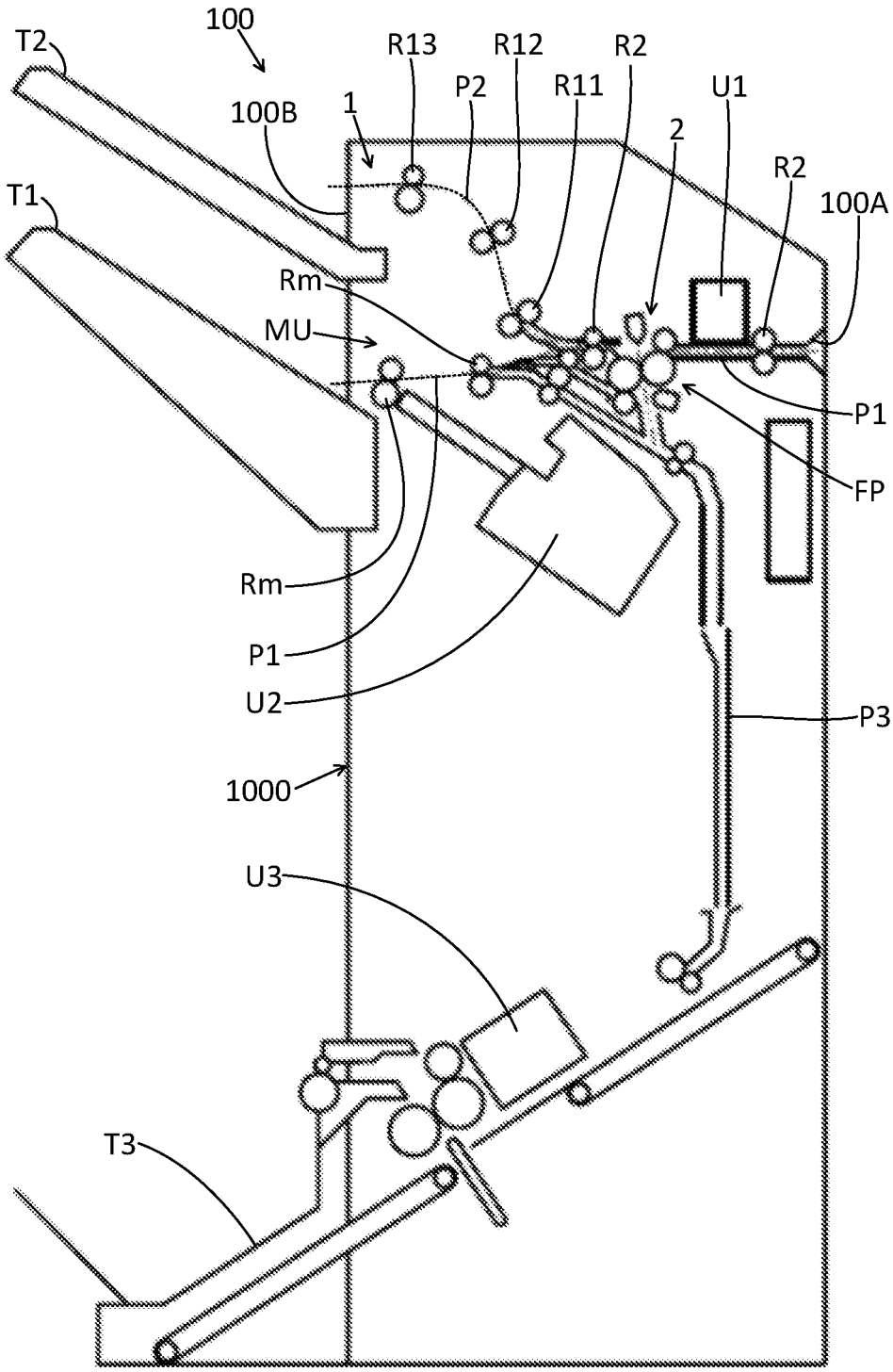
FIG. 2 is a schematic diagram showing the internal construction of the post-processing apparatus according to the embodiment.

As shown in FIG. 2, the post-processing apparatus 100 has, in its apparatus body 1000, a sheet reception port 100A, a sheet discharge port 100B, a first discharge tray T1, and a second discharge tray T2. The post-processing apparatus 100 also has a first conveyance passage P1 and a second conveyance passage P2.

The sheet reception port 100A is an opening provided at the side of the post-processing apparatus 100 coupled to the image forming apparatus 200. Through the sheet reception port 100A, a sheet is conveyed from the image forming apparatus 200 into the post-processing apparatus 100.

The first and second discharge trays T1 and T2 are provided at the side of the post-processing apparatus 100 opposite from its side coupled to the image forming apparatus 200. The first discharge tray T1 is a main discharge tray. The second discharge tray T2 is arranged above the first discharge tray T1. The post-processing apparatus 100 discharges a sheet to the first discharge tray T1 or to the second discharge tray T2. To the second discharge tray T2, a sheet is discharged through the sheet discharge port 100B.

The first conveyance passage P1 is a main conveyance passage. The first conveyance passage P1 leads from the sheet reception port 100A to a discharge port (no reference sign assigned) through which a sheet is discharged to the first discharge tray T1. The first conveyance passage P1 extends substantially in the horizontal direction from the sheet reception port 100A. The second conveyance passage P2 branches off the first conveyance passage P1 and leads to the sheet discharge port 100B. The second conveyance passage P2 extends up- and leftward from where it branches off the first conveyance passage P1.

A sheet is conveyed from the sheet reception port 100A toward the first discharge tray T1 or the second discharge tray T2. In either case, the sheet is conveyed from right to left in FIG. 2. That is, in FIG. 2, the direction from right to left is the sheet conveyance direction.

The post-processing apparatus 100 includes a punch unit U1, a staple unit U2, and a booklet unit U3. The punch unit U1, the staple unit U2, and the booklet unit U3 are each a post-processing section that performs post-processing on sheets. The punch unit U1, the staple unit U2, and the booklet unit U3 each perform corresponding post-processing on sheets. As will be described later, the post-processing apparatus 100 further includes a folding unit 2 as a unit that performs post-processing.

The punch unit U1 is arranged on the conveyance path along the first conveyance passage P1. The punch unit U1 performs punching to form punch holes in a sheet conveyed along the first conveyance passage P1.

The staple unit U2 stacks up, on a processing tray (no reference sign assigned) sheets conveyed along the first conveyance passage P1. The staple unit U2 then performs stapling to bind the stack of sheets with staples. When stapling is performed, sheets are discharged to the first discharge tray T1. When no stapling is performed, sheets can be discharged to the second discharge tray T2. Also possible is control that allows sheets to be discharged to the first discharge tray T1 with no stapling performed.

The booklet unit U3 includes a middle-binding stapling section (no reference sign assigned) that binds a stack of sheets at the middle. The booklet unit U3 performs booklet formation to middle-fold a stack of sheets that has been middle-bound by the stapling section.

For example, the post-processing apparatus 100 has a third conveyance passage P3 that branches off the first conveyance passage P1 to extend downward. The third conveyance passage P3 connects to the booklet unit U3. When booklet formation is performed, sheets are conveyed through the third conveyance passage P3 to the booklet unit U3.

The post-processing apparatus 100 also has a third discharge tray T3. The third discharge tray T3 is provided at the side of the post-processing apparatus 100 opposite from its side coupled to the image forming apparatus 200. The third discharge tray T3 is a discharge tray for a booklet, and is arranged below the first discharge tray T1. The booklet unit U3 discharges the booklet resulting from booklet formation to the third discharge tray T3.

<Configuration of Conveyance Units>

The post-processing apparatus 100 includes a main discharge unit MU. The main discharge unit MU is mounted in the apparatus body 1000. The first conveyance passage P1 is provided in the main discharge unit MU. The main discharge unit MU conveys a sheet and discharges it to the first discharge tray T1.

The main discharge unit MU includes a pair of conveyance rollers Rm. The pair of conveyance rollers Rm is arranged in the first conveyance passage P1. The pair of conveyance rollers Rm conveys a sheet along the first conveyance passage P1.

The post-processing apparatus 100 also includes a sub discharge unit 1. The sub discharge unit 1 corresponds to a "second unit". The sub discharge unit 1 is mounted in the apparatus body 1000. The sub discharge unit 1 is mounted downstream, with respect to the sheet conveyance direction, of a folding unit 2, which will be described later. The sub discharge unit 1 is an optional unit, and can be mounted and dismounted in the up-down direction from and to above the apparatus body 1000. The second conveyance passage P2 is provided in the sub discharge unit 1. The sub discharge unit 1 is a unit that conveys and discharges a sheet. The sub discharge unit 1 conveys a sheet and discharges it through the sheet discharge port 100B to the second discharge tray T2.

The sub discharge unit 1 includes a plurality of pairs of conveyance rollers R11, R12, and R13. The plurality of pairs of conveyance rollers R11, R12, and R13 are arranged in the second conveyance passage P2, in the order named from upstream to downstream with respect to the sheet conveyance direction. The plurality of pairs of conveyance rollers R11, R12, and R13 rotate while in contact with a sheet to convey the sheet along the second conveyance passage P2.

Instead of the sub discharge unit 1, a unit that does not have a function of discharging a sheet and that only conveys a sheet may be provided. That is, the "second unit" may be a unit that only conveys a sheet.

The post-processing apparatus 100 includes a folding unit 2. The folding unit 2 corresponds to a "first unit". The folding unit 2 is mounted in the apparatus body 1000. The mounting position (corresponding to a "predetermined position") of the folding unit 2 is upstream of the mounting position of the sub discharge unit 1 with respect to the sheet conveyance direction. The folding unit 2 is an optional unit of which the mounting position is a predetermined position in the apparatus body 1000, and can be mounted and dismounted in the horizontal direction from and to upstream of the sub discharge unit 1 with respect to the sheet conveyance direction. The folding unit 2 is a unit that conveys a sheet. The folding unit 2 receives a sheet conveyed from the sheet reception port 100A and conveys it downstream. The folding unit 2 is also a unit that performs folding on a sheet output from the image forming apparatus 200.

The first conveyance passage P1 is provided in the folding unit 2. The first conveyance passage P1 in the folding unit 2 connects to the first conveyance passage P1 in the main discharge unit MU. The first conveyance passage P1 in the folding unit 2 is located upstream and the first conveyance passage P1 in the main discharge unit MU is located downstream. When the discharge destination of a sheet is the first discharge tray T1, the folding unit 2 conveys the sheet toward the main discharge unit MU. The main discharge unit MU receives a sheet from the folding unit 2 and discharges it to the first discharge tray T1.

Here, the second conveyance passage P2 branches off the first conveyance passage P1 in the folding unit 2. In other words, the folding unit 2 has a branch portion between the first and second conveyance passages P1 and P2. For example, in the branch portion between the first and second conveyance passages P1 and P2, switch claws (no reference sign assigned) are pivotally provided. The switch claws, when held in a main position, keeps open the conveyance path from the folding unit 2 to the main discharge unit MU. Displacing the switch claws from the main position to a sub position closes the conveyance path from the folding unit 2 to the main discharge unit MU and opens the conveyance path from the folding unit 2 to the sub discharge unit 1.

The folding unit 2 includes a pair of conveyance rollers R2. For example, a plurality of pairs of conveyance rollers R2 may be provided. The pair of conveyance rollers R2 is arranged in the first conveyance passage P1. The pair of conveyance rollers R2 conveys a sheet along the first conveyance passage P1.

The folding unit 2 also includes a folding section FP. The folding section FP includes, for example, a folding guide that is pressed on the surface of a sheet to make a fold line, a dedicated pair of rollers that conveys, while nipping, the sheet to be folded, and a dedicated conveyance passage for conveying the sheet to be folded, of which none is assigned a reference sign. When folding is performed, a sheet is pulled into the folding section FP. When no folding is performed, a sheet is conveyed, without being pulled into the folding section FP, toward the branch portion between the first and second conveyance passages P1 and P2.

Instead of the folding unit 2, a unit that does not include a folding section FP and that only conveys a sheet may be provided. That is, the "first unit" may be a unit that only conveys a sheet.

Here, the main discharge unit MU, the sub discharge unit 1, and the folding unit 2 can each be mounted in and dismounted from the apparatus body 1000 individually. For example, despite the sub discharge unit 1 and the folding unit 2 being coupled together, folding unit 2 can be dismounted from the post-processing apparatus 100 with the sub discharge unit 1 left in the apparatus body 1000.

<Construction of the Sub Discharge Unit and the Folding Unit>

Figure 3:
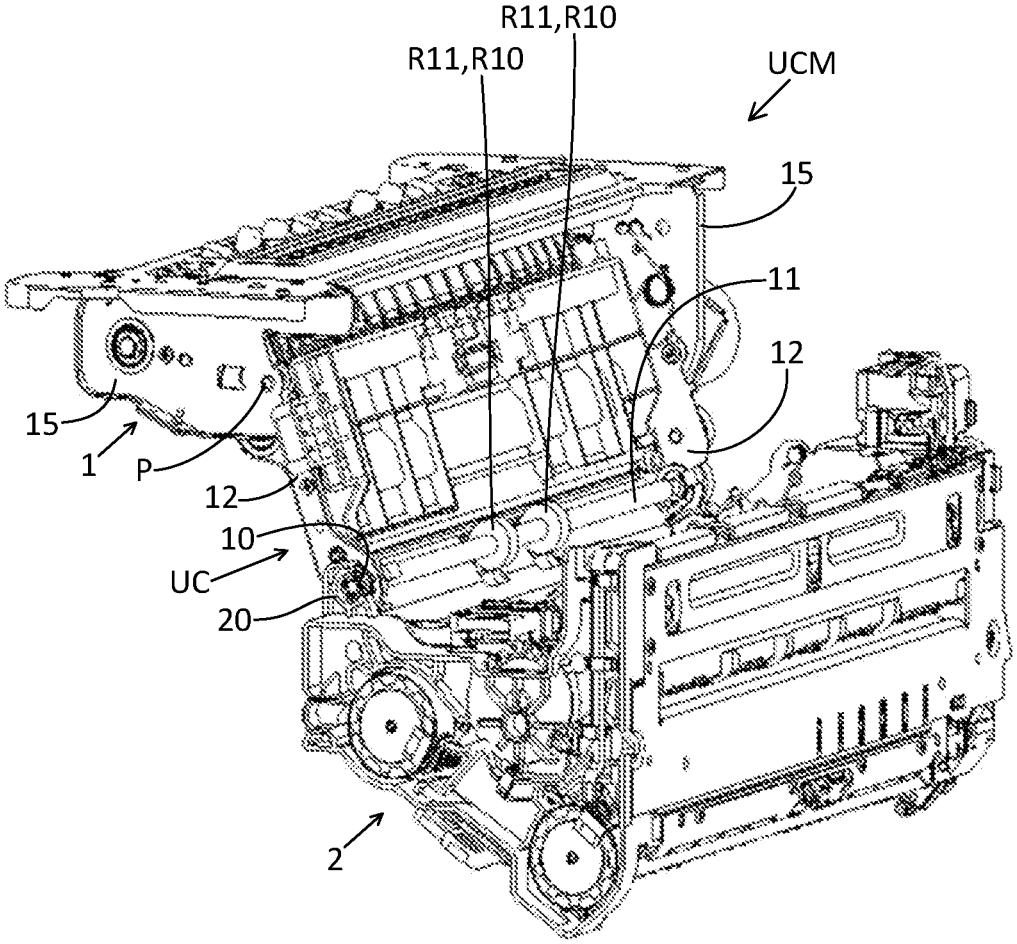
FIG. 3 is a perspective view of a unit mounted in the post-processing apparatus according to the embodiment.

The sub discharge unit 1 and the folding unit 2 are coupled together via a coupling unit UC (see FIG. 3). That is, the post-processing apparatus 100 includes a coupling unit UC. The sub discharge unit 1, the folding unit 2, and the coupling unit UC constitute a unit coupling mechanism UCM (see FIG. 3).

As will be described in detail later, the coupling unit UC includes a first coupling portion 10. The coupling unit UC is pivoted on the sub discharge unit 1. The folding unit 2 includes a second coupling portion 20. Coupling the first and second coupling portions 10 and 20 together brings the sub discharge unit 1 and the folding unit 2 into a coupled state. In other words, a state is achieved where the folding unit 2 is fixed to the sub discharge unit 1. In yet other words, the folding unit 2 is positions relative to the sub discharge unit 1. It is thus possible to prevent displacement of a sheet (including a skew or sag in the sheet) during its conveyance from the folding unit 2 to the sub discharge unit 1.

The construction will now be described specifically with reference to FIGS. 3 to 15. In the following description, the direction orthogonal to the sheet conveyance direction is referred to as the width direction. The front-rear direction with respect to the post-processing apparatus 100 as seen from in front corresponds to the width direction. The width direction corresponds to the "axial direction".

Figure 4:
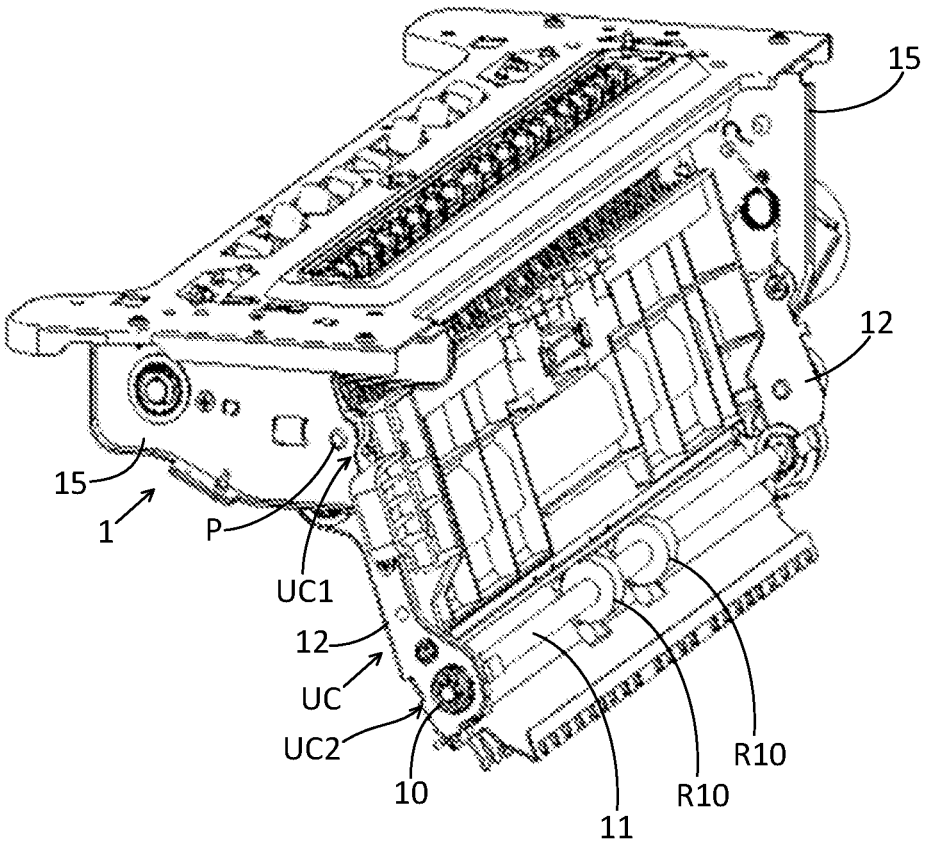
FIG. 4 is a perspective view of a sub discharge unit and a coupling unit in the post-processing apparatus according to the embodiment.
Figure 5:
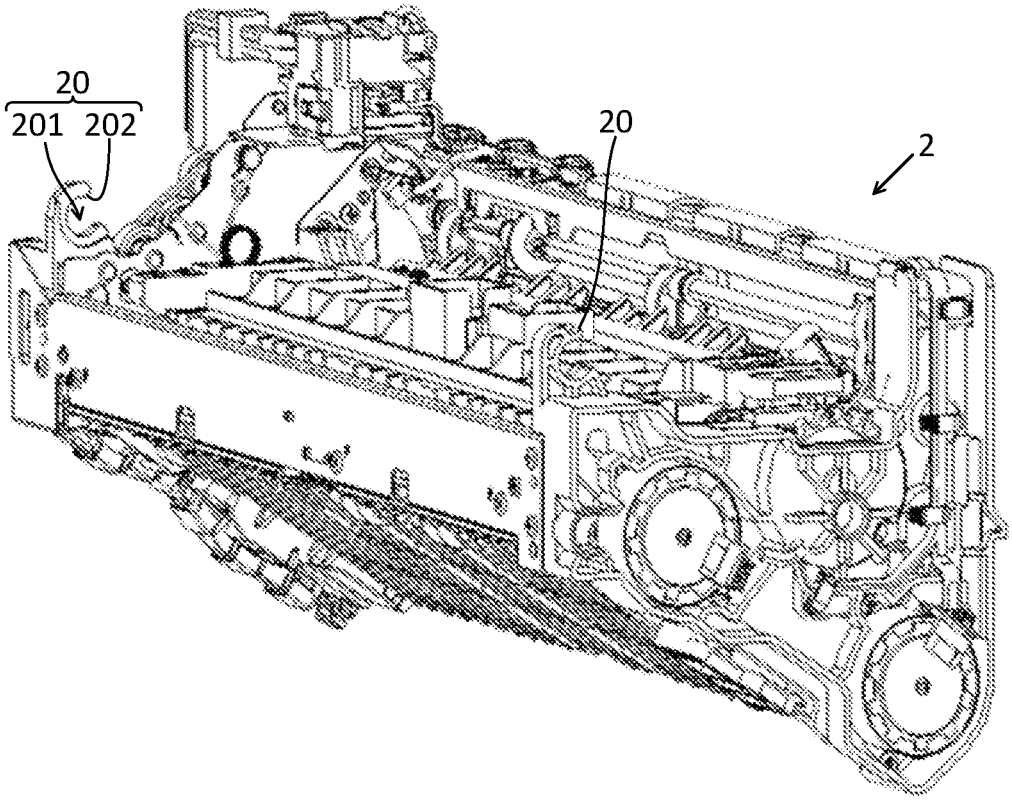
FIG. 5 is a perspective view of a folding unit in the post-processing apparatus according to the embodiment.
Figure 6:
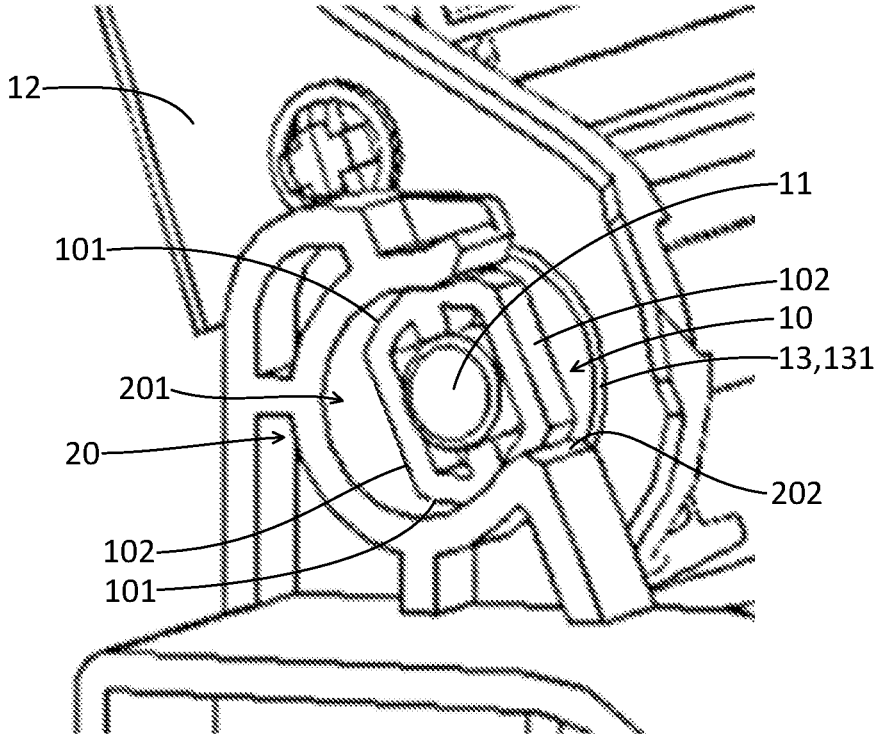
FIG. 6 is an enlarged perspective view, as seen from outward, of and around the coupling position between a first and a second coupling portion in the post-processing apparatus according to the embodiment.
Figure 7:
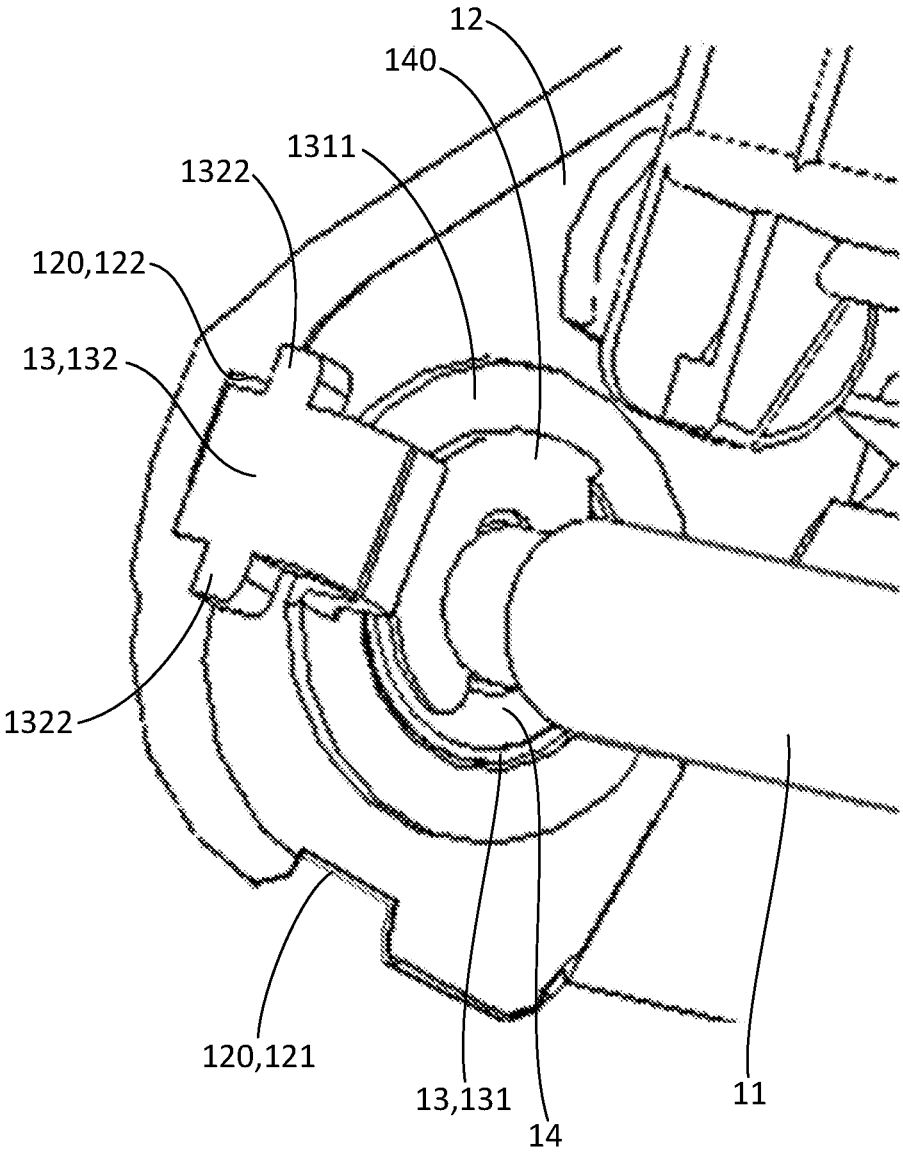
FIG. 7 is an enlarged perspective view, as seen from inward, of and around the coupling position between the first and second coupling portions in the post-processing apparatus according to the embodiment.

The sub discharge unit 1 and the folding unit 2 in a coupled state are shown in FIG. 3. The sub discharge unit 1 and the coupling unit UC are shown in FIG. 4, and the folding unit 2 is shown in FIG. 5. The first and second coupling portions 10 and 20 in a coupled state is shown in FIGS. 6 and 7, FIG. 6 being a view as seen from one side (outward) along the width direction and FIG. 7 being a view as seen from the other side (inward) along the width direction.

<Fixing Between Units>

The sub discharge unit 1 along with the coupling unit UC constitutes a single unit. In other words, the sub discharge unit 1 is not separated from the coupling unit UC.

The coupling unit UC has a one-end portion UC1, which is pivoted on the sub discharge unit 1, and an other-end portion UC2, which is swingable in the up-down direction about a pivoted part of the one-end portion UC1 and which is decouplably coupled to the folding unit 2. The coupling unit UC conveys a sheet from the folding unit 2 to the sub discharge unit 1. In other words, the coupling unit UC also is a unit that conveys a sheet. In yet other words, the coupling unit UC along with the sub discharge unit 1 constitute a sheet conveyance unit.

The coupling unit UC includes pairs of conveyance rollers R11 and R12 (see FIG. 2). The sub discharge unit 1 includes a pair of conveyance rollers R13 (see FIG. 2). Thus, the coupling unit UC is arranged upstream of the sub discharge unit 1 with respect to the sheet conveyance direction; it receives a sheet from the folding unit 2 and conveys it to the sub discharge unit 1. The sub discharge unit 1 receives a sheet from the folding unit 2 via the coupling unit UC.

Here, as seen along the width direction, the arrangement position of one conveyance roller in the pair of conveyance rollers R11 is the coupling position between the other-end portion UC2 of the coupling unit UC and the folding unit 2. In the following description, the one conveyance roller located in that coupling position is identified by the reference sign R10 for distinction from the other conveyance rollers.

The coupling unit UC includes a shaft 11 extending along the width direction. The shaft 11 is arranged in the other-end portion UC2 of the coupling unit UC. The shaft 11 is rotatably supported. The conveyance roller R10 rotates together with the shaft 11. That is, as seen along the width direction, the shaft 11 is arranged at the coupling position between the other-end portion UC2 and the folding unit 2. The conveyance roller R10, by rotating together with the shaft 11, conveys a sheet. The coupling unit UC, by making the conveyance roller R10 rotate together with the shaft 11, conveys a sheet from the folding unit 2 to the sub discharge unit 1.

The coupling unit UC includes a shaft fitting plate 12, which is a plate-form member to which the shaft 11 is fitted. The coupling unit UC includes, as the shaft fitting plate 12, a part of the housing (frame) of the coupling unit UC. For example, the coupling unit UC has, as a part of its housing, a pair of side plates facing each other along the width direction. The pair of side plates each has its thickness direction aligned with the width direction. The pair of side plates each serve as the shaft fitting plate 12. That is, the shaft fitting plate 12 comprise a pair of side plates facing each other along the width direction. In the shaft fitting plate 12, a fitting hole 12*a* (see FIG. 11) is formed that penetrates it along the width direction.

Figure 8:
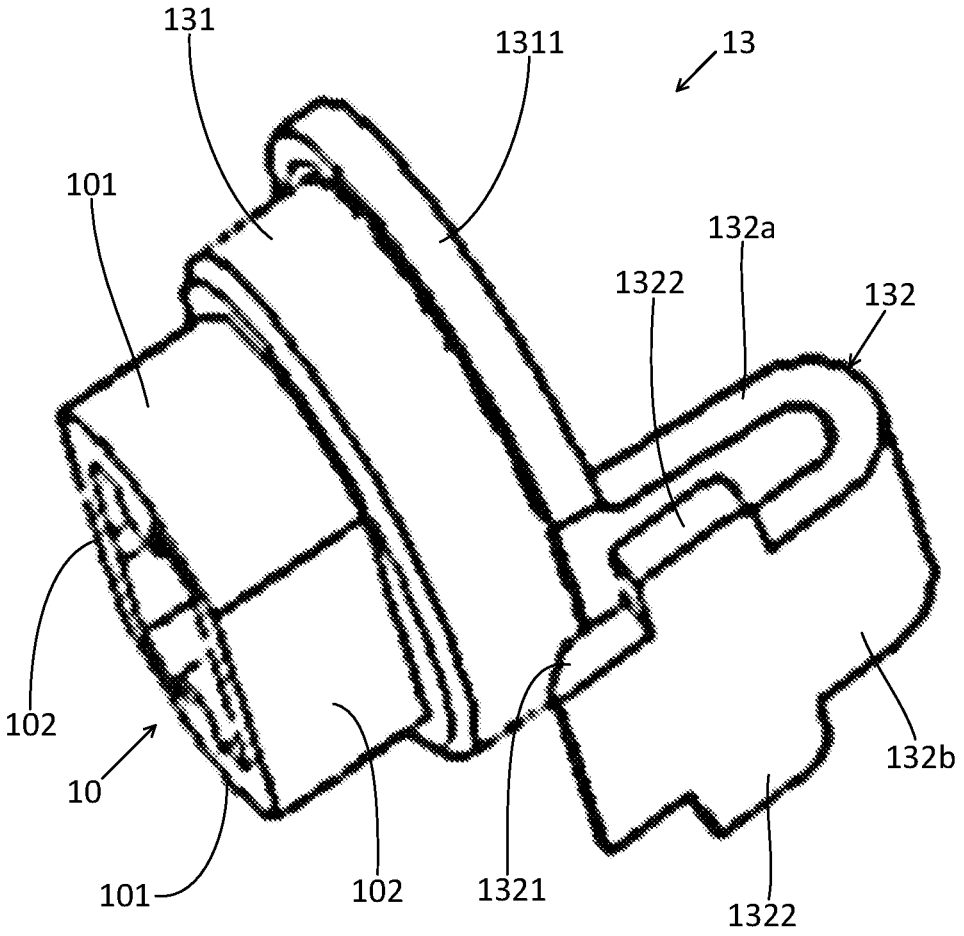
FIG. 8 is a perspective view of the first coupling portion in the post-processing apparatus according to the embodiment.

The coupling unit UC includes a shaft holder 13 as shown in FIG. 8. The shaft holder 13 is fitted to each of opposite end parts of the shaft 11 along the width direction. The shaft holder 13 supports the opposite end parts of the shaft 11 along the width direction. Specifically, the coupling unit UC further includes a bearing 14 (see FIG. 7). The bearing 14 is fitted to each of the opposite end parts of the shaft 11 along the width direction. The inner ring of the bearing 14 is fixed to the shaft 11. The outer ring of the bearing 14 is fixed to the shaft holder 13. Thus the shaft 11 is supported so as to be rotatable at its opposite ends along the width direction. The shaft holder 13 is rotatable about the center axis of the shaft 11. The bearing 14 is restrained by a stopper ring 140 (see FIG. 7) from being displaced along the width direction on the shaft 11.

In the following description, with respect to the width direction (the front-rear direction of the post-processing apparatus 100), which is orthogonal to the sheet conveyance direction, the direction away from the center of the shaft 11 is referred to as outward and the direction toward the center of the shaft 11 is referred to as inward.

The shaft holder 13 has a holder body 131. The holder body 131 is a part formed in a cylindrical shape, and has an opening (no reference sign assigned) inward along the width direction. The bearing 14 is fitted through that opening into the holder body 131. The outer ring of the bearing 14 is fixed to the inner circumferential face of the holder body 131. With the bearing 14 fitted inside the holder body 131, a tip end of the shaft 11 protrudes out of the holder body 131, outward along the width direction.

On the outer circumference of the holder body 131, inward along the width direction (i.e., around the rim of the opening), a brim portion 1311 is formed. That is, the shaft holder 13 has a brim portion 1311 formed on the holder body 131 at one side along the width direction. The brim portion 1311 is ring-shaped. The brim portion 1311 protrudes along the radial direction from the outer circumference of the holder body 131 all around it.

The holder body 131 is inserted into the fitting hole 12*a* in the shaft fitting plate 12 from inward along the width direction, and is thereby fitted in the fitting hole 12*a*. The holder body 131 protrudes outward from the shaft fitting plate 12. The outer diameter of the brim portion 1311 is larger than the diameter of the fitting hole 12*a*. This prevents the shaft holder 13 from falling off outward.

Here, the shaft holder 13 has a first coupling portion 10. The first coupling portion 10 is used to couple the coupling unit UC and the folding unit 2 together.

The first coupling portion 10 is a protruding part that protrudes from the holder body 131 outward along the width direction. The outer shape of the first coupling portion 10 as seen along the width direction is oval (oblong-circular). That is, as seen along the width direction, the first coupling portion 10 has a pair of arc-shaped faces 101 arranged point-symmetrically about the center axis of the shaft 11. The pair of arc-shaped faces 101 face away from each other. Moreover, as seen along the width direction, the first coupling portion 10 has a pair of flat faces 102 extending parallel to each other. The outer shape of the first coupling portion 10 as seen along the width direction may be elliptical. The outer shape of the first coupling portion 10 as seen along the width direction may be one with recesses in the faces corresponding to the flat faces 102.

The first coupling portion 10 is formed in an oval shape as seen along the width direction so as to have a large-diameter portion (no reference sign assigned) with a larger width along the radial direction and a small-diameter portion (no reference sign assigned) with a smaller width along the radial direction than the large-diameter portion. The large-diameter portion of the first coupling portion 10 is a part defined by the pair of arc-shaped faces 101. The small-diameter portion of the first coupling portion 10 is a part defined by the pair of flat faces 102.

Figure 9:
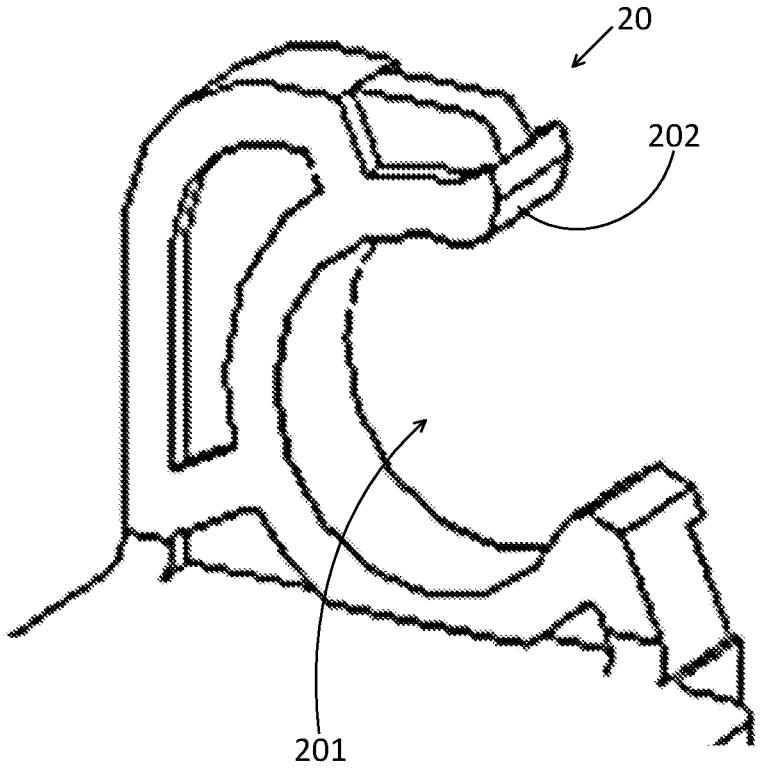
FIG. 9 is a perspective view of the second coupling portion in the post-processing apparatus according to the embodiment.
Figure 10:
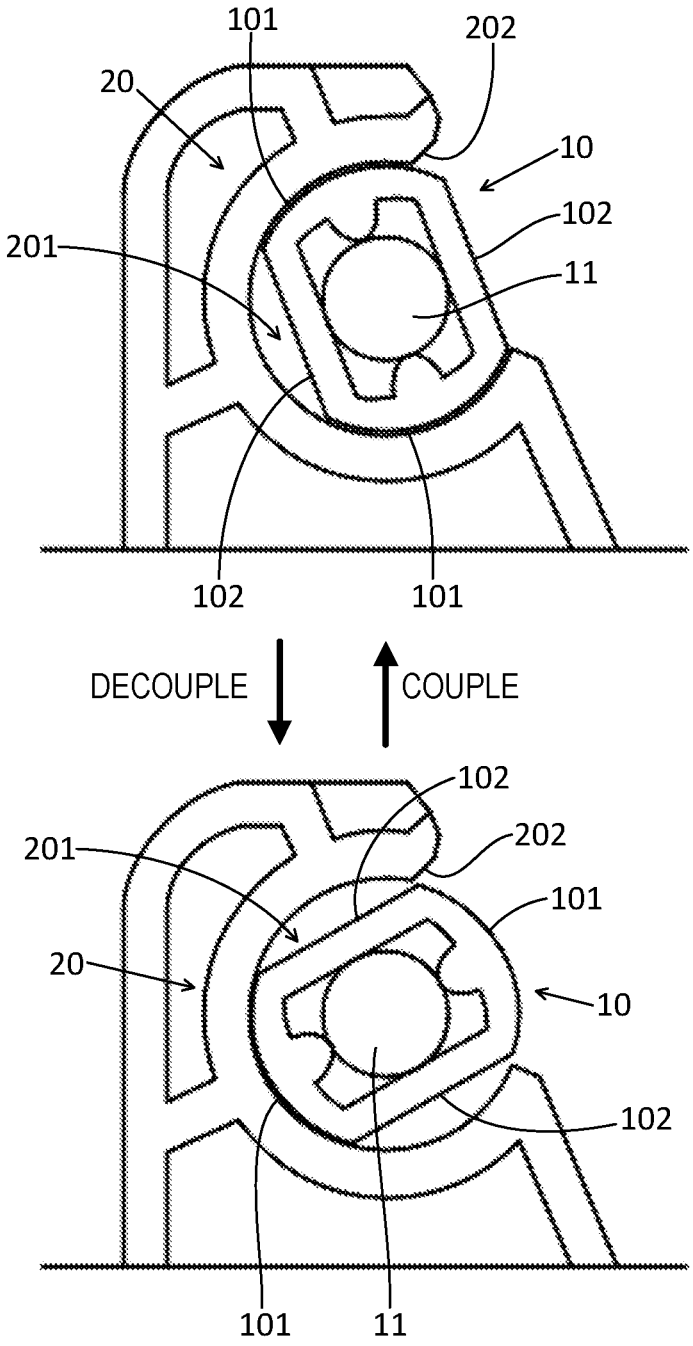
FIG. 10 is a diagram showing the positional relationship between the first and second coupling portions in the post-processing apparatus according to the embodiment.
Figure 11:
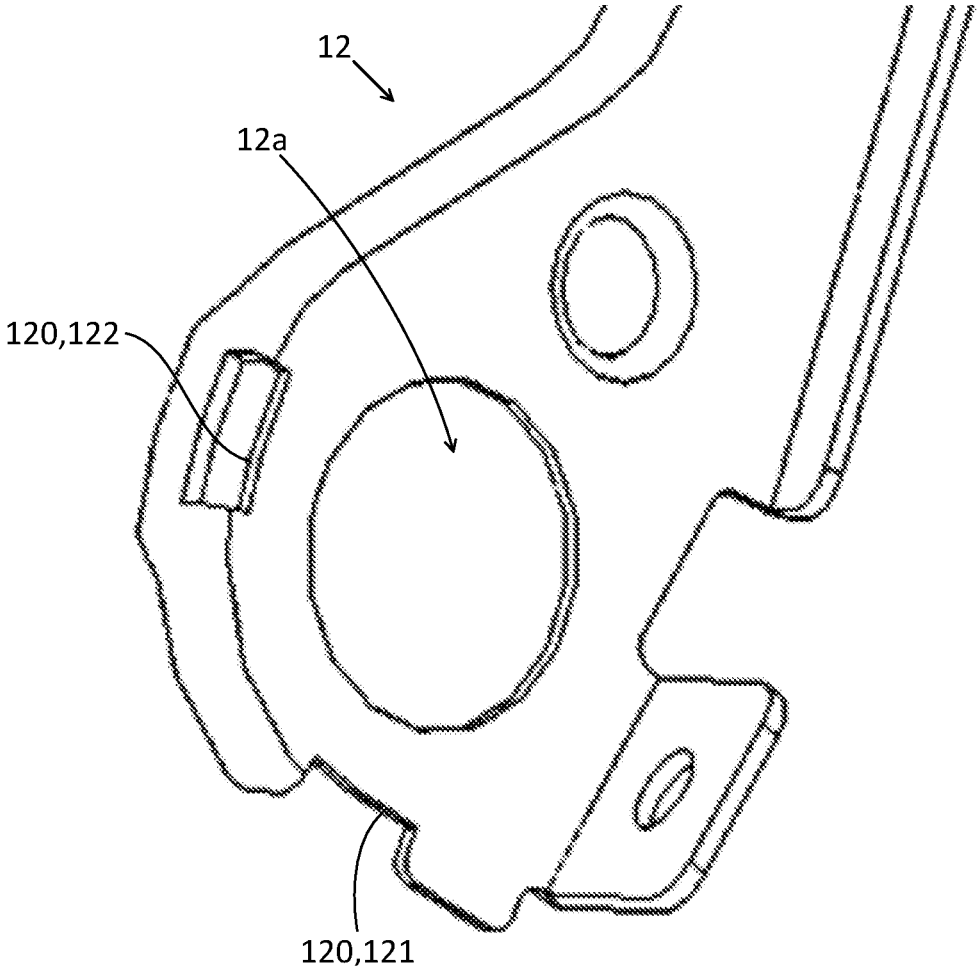
FIG. 11 is an enlarged perspective view around a fitting hole in a shaft fitting plate in the post-processing apparatus according to the embodiment.

The folding unit 2 further includes a second coupling portion 20 as shown in FIG. 9. The second coupling portion 20 couples to (engages with) the first coupling portion 10. Coupling the first and second coupling portions 10 and 20 together brings the sub discharge unit 1 and the folding unit 2 into a state coupled via the coupling unit UC. That is, the folding unit 2 can be fixed to the sub discharge unit 1.

The second coupling portion 20 is provided on each of a pair of side plates of the housing of the folding unit 2 facing each other along the width direction. The second coupling portion 20 may be formed integrally with the housing of the folding unit 2, or may be fitted as a separate member to it.

The second coupling portion 20 is arranged at each of the opposite sides of the shaft 11 along the width direction. The pair of shaft fitting plates 12 are each arranged inward of the second coupling portion 20 along the width direction at the same side along the width direction. That is, the pair of shaft fitting plates 12 are each arranged outward of the shaft fitting plate 12 along the width direction at the same side along the width direction. The pair of first coupling portions 10 each protrude toward the second coupling portion 20 at the same side along the width direction.

The second coupling portion 20 has a coupling hole 201 that penetrates it along the width direction. The shape of the coupling hole 201 as seen along the width direction is partly-cut circular. That is, the second coupling portion 20 has a communication port 202 through which the space inside the coupling hole 201 along the radial direction communicates with the space outside it. The communication port 202 penetrates between the spaces inside and outside the coupling hole 201 as seen along the width direction. As seen along the width direction, the communication port 202 is open toward upstream with respect to the sheet conveyance direction.

With the sub discharge unit 1 and the folding unit 2 in a coupled state, the first coupling portion 10 is inserted in the coupling hole 201 in the second coupling portion 20 (see FIG. 6). In other words, the second coupling portion 20 has a coupling hole 201 in which the first coupling portion 10 is fitted. Here, the first coupling portion 10 has a pair of arc-shaped faces 101. The pair of arc-shaped faces 101 are arranged point-symmetrically about the center axis of the shaft 11 as seen along the width direction. The first coupling portion 10 also has a pair of flat faces 102. The pair of flat faces 102 are parallel to each other as seen along the width direction.

With the first coupling portion 10 inserted in the coupling hole 201, the pair of arc-shaped faces 101 can simultaneously lie in contact with the inner circumferential face of the coupling hole 201. On the other hand, regardless of the position of the first coupling portion 10 in the coupling hole 201, the pair of flat faces 102 stay out of contact with the inner circumferential face of the coupling hole 201.

Inserting the first coupling portion 10 into the coupling hole 201 and keeping the pair of arc-shaped faces 101 in contact with the inner circumferential face of the coupling hole 201 (the state shown in FIG. 6) results in the first and second coupling portions 10 and 20 being coupled (fixed) together. Coupling the first and second coupling portions 10 and 20 together results in the sub discharge unit 1 and the folding unit 2 being coupled together. That is, the folding unit 2 can be fixed to the sub discharge unit 1.

<Coupling and Decoupling Between Units>

The fitting tolerance of the first coupling portion 10 with respect to the coupling hole 201 is so set that the first coupling portion 10 can be rotated manually. For example, the fitting tolerance of the first coupling portion 10 with respect to the coupling hole 201 can be medium fitting.

The coupling hole 201 has, as the communication port 202, an opening through which, as seen along the axial direction, the small-diameter portion of the first coupling portion 10, which swings together with the other-end portion UC2, can pass but its large-diameter portion cannot pass. That is, as seen along the width direction, the large-diameter portion has such a width that it cannot pass through the communication port 202. On the other hand, as seen along the width direction, the small-diameter portion has such a width that it can pass through the communication port 202.

By making the pair of arc-shaped faces 101 of the first coupling portion 10 simultaneously in contact with the inner circumferential face of the coupling hole 201, it is possible to couple (fix) the folding unit 2 to the sub discharge unit 1. In other words, unless one of the pair of arc-shaped faces 101 of the first coupling portion 10 is in contact with the inner circumferential face of the coupling hole 201, the folding unit 2 is not coupled to the sub discharge unit 1. In yet other words, unless one of the pair of arc-shaped faces 101 of the first coupling portion 10 is in contact with the inner circumferential face of the coupling hole 201, the folding unit 2 is displaced relative to the sub discharge unit 1.

Here, even with the first coupling portion 10 inserted in the coupling hole 201, since the first coupling portion 10 is rotatable about the center axis of the shaft 11, by rotating the first coupling portion 10, it is possible to displace the pair of arc-shaped faces 101. Moreover, the second coupling portion 20 has a communication port 202 that penetrates an edge of the coupling hole 201 along the radial direction. In other words, the second coupling portion 20 has a communication port 202 through which the spaces inside and outside the coupling hole 201 along the radial direction communicate with each other.

Thus, with the folding unit 2 coupled to the sub discharge unit 1, rotating the first coupling portion 10 such that one of the pair of arc-shaped faces 101 points to the communication port 202 makes one of the pair of arc-shaped faces 101 move out of contact with the inner circumferential face of the coupling hole 201. In this way, the sub discharge unit 1 and the folding unit 2 can be decoupled from each other. This will now be described taking up as an example a case where they are seen from one side (front side) along the width direction.

The first coupling portion 10, in a state inserted in the coupling hole 201, rotates inside the fitting hole 12*a* in the shaft fitting plate 12 about the center axis of the shaft 11 so as to be arranged selectively either in a coupled position or in a decoupled position. Rotating inside the fitting hole 12*a* in the shaft fitting plate 12 the shaft holder 13 so as to fix the angle of the first coupling portion 10 as seen along the width direction (the position of the pair of arc-shaped faces 101 and the pair of flat faces 102 as seen along the width direction) at a first angle brings the first coupling portion 10 into the decoupled position. From this state, rotating the shaft holder 13 further so as to fix the angle of the first coupling portion 10 as seen along the width direction at a second angle brings the first coupling portion 10 into the coupled position. For example, the first coupling portion 10 is rotated by a serviceperson who checks, replaces, or otherwise handles the post-processing apparatus 100.

The coupled position is the position where the folding unit 2 is coupled (fixed) to the sub discharge unit 1. That is, with the first coupling portion 10 in the coupled position, the pair of arc-shaped faces 101 are both in contact with the inner circumferential face of the coupling hole 201 (see the upper diagram in FIG. 10).

With the first coupling portion 10 in the coupled position, the first coupling portion 10 cannot pass through the communication port 202. That is, with the first coupling portion 10 in the coupled position, the angle of the first coupling portion 10 as seen along the width direction is the second angle.

On the other hand, the decoupled position is the position where the folding unit 2 is decoupled (separated) from the sub discharge unit 1. That is, with the first coupling portion 10 in the decoupled position, one of the pair of arc-shaped faces 101 lies in contact with the inner circumferential face of the coupling hole 201 and the other of the pair of arc-shaped faces 101 is arranged in the communication port 202 to stay out of contact with the inner circumferential face of the coupling hole 201 (see the lower diagram in FIG. 10).

With the first coupling portion 10 in the decoupled position, the first coupling portion 10 can pass through the communication port 202. That is, with the first coupling portion 10 in the decoupled position, the angle of the first coupling portion 10 as seen along the width direction is the first angle.

With this construction, when the sub discharge unit 1 and the folding unit 2 are coupled (fixed) together, the shaft holder 13 is rotated inside the fitting hole 12*a* in the shaft fitting plate 12 to fix the first coupling portion 10 at the first angle so that the first coupling portion 10 can pass through the communication port 202, and through the communication port 202 the first coupling portion 10 is inserted into the coupling hole 201; then the shaft holder 13 is rotated inside the fitting hole 12*a* in the shaft fitting plate 12 to fix the first coupling portion 10 at the second angle so that the first coupling portion 10 cannot pass through the communication port 202, and thus the sub discharge unit 1 and the folding unit 2 are coupled together.

It is thus possible to enhance the convenience to a serviceperson who checks, replaces, or otherwise handles the units mounted in the post-processing apparatus 100. Specifically, when the sub discharge unit 1 or the folding unit 2 is mounted in or dismounted from the apparatus body 1000, simply rotating the first coupling portion 10 permits the folding unit 2 to be coupled to or decoupled from the sub discharge unit 1 (coupling unit UC), with no need for manipulation such as partial disassembly of units. It is thus possible to facilitate the mounting and dismounting of units with respect to the apparatus body 1000.

Moreover, with the construction where the communication port 202 is formed in the second coupling portion 20, by rotating the first coupling portion 10, it is possible to easily achieve a state where, of the pair of arc-shaped faces 101, one lies in contact with the inner circumferential face of the coupling hole 201 and the other stays out of contact with the inner circumferential face of the coupling hole 201. In other words, by rotating the first coupling portion 10, it is possible to switch between a state where the first coupling portion 10 can pass through the communication port 202 and a state where the first coupling portion 10 cannot pass through the communication port 202.

Furthermore, when the first coupling portion 10 is inserted into the coupling hole 201, the first coupling portion 10 does not need to be inserted along the width direction. Specifically, simply moving the first coupling portion 10, as seen along the width direction, from outside to inside the coupling hole 201 through the communication port 202 permits the first coupling portion 10 to be inserted in the coupling hole 201. Thus, it is possible, without removing the shaft holder 13, the bearing 14, and the like from the shaft 11, that is, without disassembling the mechanism for rotatably supporting the shaft 11, to fit the first coupling portion 10 into the coupling hole 201. This facilitates the coupling and decoupling of the folding unit 2 with respect to the sub discharge unit 1.

With the construction where a part of the shaft holder 13, to which the bearing 14 is fixed, is used as the first coupling portion 10, it is possible to suppress an increase in the number of components.

With the configuration where a part of the shaft holder 13 is used as the first coupling portion 10, it is possible to position the sub discharge unit 1 and the folding unit 2 relative to each other with reference to the rotation axis (i.e., the shaft 11) of the conveyance roller R10, which serves to convey a sheet. It is thus possible to suppress displacement of a sheet during its conveyance from the folding unit 2 to the sub discharge unit 1. It is thus possible to prevent a sag or skew in the sheet.

<Positioning of the Shaft Holder>

The shaft fitting plate 12 has an engagement portion 120 (see FIG. 11) in an other-end portion UC2-side part of it, in an outer circumferential part as seen along the width direction. The engagement portion 120 is a hole and a cut or the like formed in the shaft fitting plate 12. The engagement portion 120 includes a first engagement portion 121 and a second engagement portion 122.

Moreover, the shaft holder 13 has a hook 132 (see FIG. 8) that is engageable with the engagement portion 120. The hook 132 corresponds to a "locking segment". The hook 132 is connected to the holder body 131. The hook 132 is formed in a U-shape so as to have a first segment 132*a* extending from the brim portion 1311 inward along the width direction and a second segment 132*b* turning back from the first segment 132*a* to extend outward along the width direction. The hook 132 has an engagement projection 1321. The engagement projection 1321 is formed on the hook 132 at a tip end part of it at the side opposite from the side connected to the holder body 131. Of the hook 132 the engagement projection 1321 can engage with the engagement portion 120. Engaging the engagement projection 1321 with the engagement portion 120 brings the hook 132 and the engagement portion 120 into an engaged state.

The shaft holder 13 is rotatable about the center axis of the shaft 11. As the shaft holder 13 rotates, the engagement projection 1321 pivots about the center axis of the shaft 11. The engagement projection 1321 can pivot between the first engagement portion 121 and the second engagement portion 122. In other words, the shaft fitting plate 12 has a first engagement portion 121 and a second engagement portion 122 with one of which the hook 132 is selectably engageable.

Engaging the first engagement portion 121 and the hook 132 with each other results in the first coupling portion 10 being fixed at the first angle. Rotating the shaft holder 13 inside the fitting hole 12*a* in the shaft fitting plate 12 to fix the first coupling portion 10 at the first angle achieves the state where the first coupling portion 10 can pass through the communication port 202 (the state where the first coupling portion 10 is in the decoupled position). Unless the first engagement portion 121 and the hook 132 are disengaged from each other, the first coupling portion 10 is held in the decoupled position. In this state, one of the pair of arc-shaped faces 101 lies in contact with the inner circumferential face of the coupling hole 201 and the other of the pair of arc-shaped faces 101 is arranged in the communication port 202 to stay out of the inner circumferential face of the coupling hole 201. That is, with the first engagement portion 121 and the hook 132 in the engaged state, the folding unit 2 is decoupled (separated) from the sub discharge unit 1.

Engaging the second engagement portion 122 and the hook 132 with each other results in the first coupling portion 10 being fixed at the second angle. Rotating the shaft holder 13 inside the fitting hole 12*a* in the shaft fitting plate 12 to fix the first coupling portion 10 at the second angle achieves a state where the first coupling portion 10 cannot pass through the communication port 202 as seen along the width direction (the state where the first coupling portion 10 is in the coupled position). Unless the second engagement portion 122 and the hook 132 are disengaged from each other, the first coupling portion 10 is held in the coupled position. In this state, the pair of arc-shaped faces 101 are both in contact with the inner circumferential face of the coupling hole 201. That is, with the second engagement portion 122 and the hook 132 engaged with each other, the folding unit 2 is coupled (fixed) to the sub discharge unit 1.

With the configuration where the shaft fitting plate 12 has the engagement portion 120 and the hook 132 engageable with the engagement portion 120 is provided in the shaft holder 13, even though the first coupling portion 10 is rotatable about the center axis of the shaft 11, it is possible to reliably hold the folding unit 2 in a state coupled (fixed) to the sub discharge unit 1. In other words, it is possible to prevent the first coupling portion 10 from rotating unexpectedly. It is thus possible to suppress rattling between the sub discharge unit 1 and the folding unit 2.

Here, the hook 132 is deformable along the width direction. By forming the hook 132 in a U-shape, it is easy to make the hook 132 deformable.

The engagement projection 1321 engages with the engagement portion 120 along the width direction. Thus, by deforming the hook 132 by pulling outward a tip part of the hook 132 where it has the engagement projection 1321, it is possible to disengage the hook 132 and the first engagement portion 121 from each other. Then, with the hook 132 still pulled outward, rotating the first coupling portion 10 and, at the position where the hook 132 and the second engagement portion 122 are engaged with each other, releasing the hook 132 from the pulling permits the hook 132 to restore its original shape. It is thus possible to engage the hook 132 and the second engagement portion 122 with each other. Also when the engagement destination of the hook 132 is changed from the second engagement portion 122 to the first engagement portion 121, by deforming the hook 132, it is possible to engage the hook 132 and the first engagement portion 121 with each other.

In such manipulation, it is preferable that, when rotating the first coupling portion 10, the serviceperson finds the hook 132 easy to hold. Accordingly, the shaft holder 13 has a manipulation portion 1322. The manipulation portion 1322 is formed in a tip end part of the hook 132 at the side opposite from the side at which it is connected to the holder body 131. In that tip end part is also formed the engagement projection 1321. As seen along the width direction, the manipulation portion 1322 protrudes along the circumferential direction of the holder body 131, which is the cylindrical part of the shaft holder 13. In other words, the hook 132 has a manipulation portion 1322 that bulges from a side edge of the second segment 132*b* and that the serviceperson can hold. The manipulation portion 1322 is held by the serviceperson when rotating the first coupling portion 10 between the coupled position and the decoupled position. The manipulation portion 1322 comprises, for example, a pair of projections that protrude in opposite directions.

Providing the manipulation portion 1322 on the hook 132 makes the hook 132 easy to pull. Moreover, arranging the manipulation portion 1322 in a tip end part of the hook 132 where it has the engagement projection 1321 makes it easy to engage and disengage the engagement projection 1321 with respect to the engagement portion 120.

<Taking Out Units>

The main discharge unit MU, the sub discharge unit 1, and the folding unit 2 can be removed from the apparatus body 1000 individually, unit by unit. For example, when the folding unit 2 is removed from the apparatus body 1000, first the folding unit 2 needs to be decoupled (separated) from the sub discharge unit 1. After the decoupling, moving the folding unit 2 in the horizontal direction permits the folding unit 2 to be removed from upstream of the apparatus body 1000 with respect to the sheet conveyance direction. When the folding unit 2 is mounted at a predetermined position in the apparatus body 1000, first the folding unit 2 is arranged at the predetermined position from upstream of the apparatus body 1000 with respect to the sheet conveyance direction, and then the folding unit 2 is coupled (fixed) to the sub discharge unit 1 via the coupling unit UC.

However, even when the folding unit 2 is decoupled (separated) from the sub discharge unit 1, the coupling unit UC is still present. Thus, simply decoupling the folding unit 2 from the sub discharge unit 1 does not permit the folding unit 2 to be removed from the apparatus body 1000.

To cope with this, the coupling unit UC has a one-end portion UC1 pivoted on the sub discharge unit 1 and an other-end portion UC2 that is swingable about the pivoted part of the one-end portion UC1 and that is decouplably coupled to the folding unit 2. That is, inside the apparatus body 1000, the coupling unit UC can swing its other-end portion UC2 in the up-down direction about the pivoted part of the one-end portion UC1. By moving (pivoting) the other-end portion UC2 upward, it is possible to remove the folding unit 2 from upstream of the apparatus body 1000 with respect to the sheet conveyance direction while leaving the sub discharge unit 1 in the apparatus body 1000.

Figure 12:
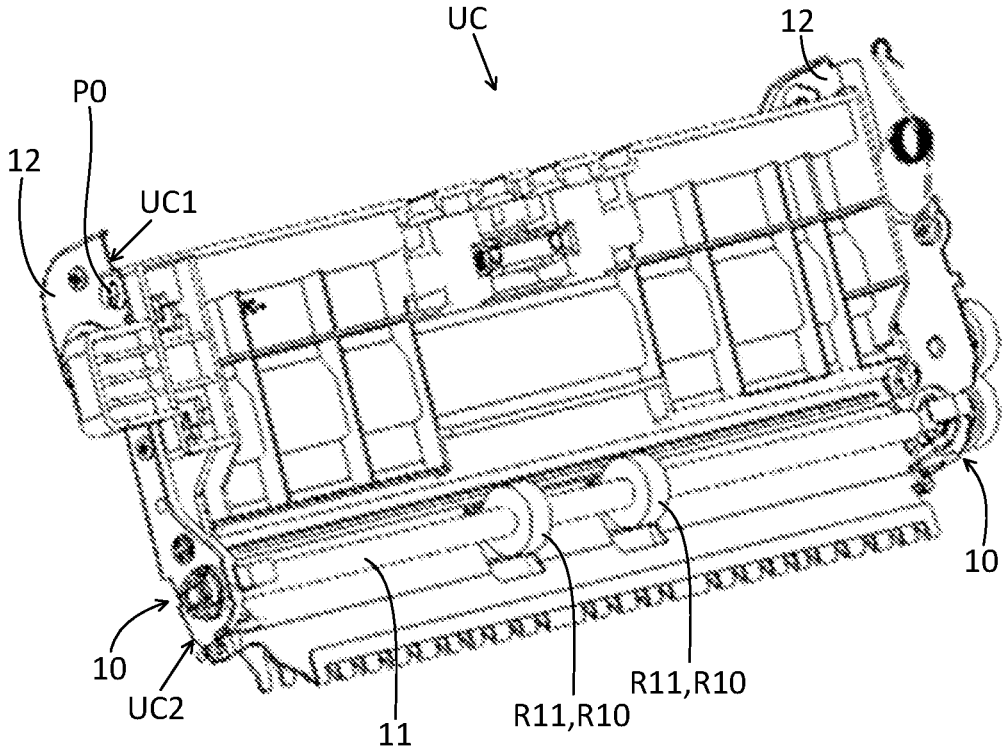
FIG. 12 is a perspective view of a coupling unit in the post-processing apparatus according to the embodiment.
Figure 13:
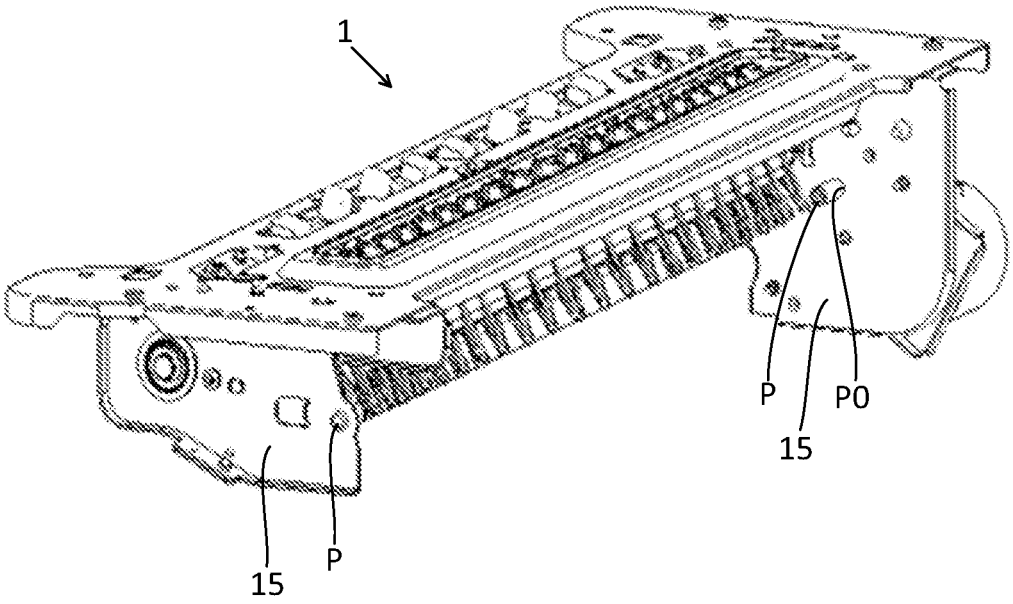
FIG. 13 is a perspective view of the sub discharge unit in the post-processing apparatus according to the embodiment.

It should be noted that, inside the apparatus body 1000, the coupling unit UC is not separated from the sub discharge unit 1. That is, the coupling unit UC along with the sub discharge unit 1 constitutes a single unit. The coupling unit UC and the sub discharge unit 1 are each a mechanism portion that conveys a sheet. The coupling unit UC receives a sheet from the folding unit 2 and conveys the sheet. The sub discharge unit 1 receives a sheet from the coupling unit UC, conveys the sheet, and discharges the sheet to the second discharge tray T2. FIGS. 12 and 13 show the coupling unit UC and the sub discharge unit 1, respectively, on its own.

The coupling unit UC has, as a part of its housing, the shaft fitting plate 12, which is a pair of side plates that face each other along the width direction. The sub discharge unit 1 as, as a part of its housing, a pair of side plates 15 that face each other along the width direction. The side plates 15 of the sub discharge unit 1 are different members from the shaft fitting plate 12. As will be described in detail later, with the sub discharge unit 1 mounted in the apparatus body 1000, the sub discharge unit 1 is fixed, and the coupling unit UC is lifted relative to the sub discharge unit 1. Accordingly, in the following description, the side plates 15 of the sub discharge unit 1 are referred to as the fixed side plates 15.

The pair of fixed side plates 15 each partly overlap the shaft fitting plate 12 located at the same side. In the following description, for the sake of convenience, the region in which the fixed side plate 15 overlaps the shaft fitting plate 12 is referred to as the side plate overlap region.

The sub discharge unit 1 further includes a pivot pin P. On the other hand, in the side plate overlap region on the shaft fitting plate 12, a pin hole P0 is formed that penetrates it along the width direction. Likewise, also in the side plate overlap region on the fixed side plate 15, a pin hole P0 is formed that penetrates it along the width direction. The pivot pin P is arranged at each of the opposite sides along the width direction. Each pivot pin P is inserted in each of the pin holes P0 in the shaft fitting plate 12 and the fixed side plate 15 at the same side along the width direction. Thus, the shaft fitting plate 12 is rotatable about the pivot pin P.

The pin hole P0 is arranged in an end part of the shaft fitting plate 12 at the side opposite from an end part of it in which the fitting hole 12*a* is arranged. Accordingly, the coupling unit UC is rotatable so as to swing in the up-down direction an end part of the shaft fitting plate 12 in which the fitting hole 12*a* is arranged. In other words, as seen along the width direction, the coupling unit UC has a one-end portion UC1 supported on the pivot pin P. Moreover, the coupling unit UC pivots so as to swing in the up-down direction the other-end portion UC2 about the pivot pin P. With this construction, a part of the one-end portion UC1 where the pin hole P0 is formed corresponds to a "pivoted part". As seen along the width direction, the shaft holder 13 is arranged in the other-end portion UC2 so as to be pivotable about the pivot pin P. The upstream is coupled to the sub discharge unit 1 via the pivot pin P.

The first coupling portion 10 is a part of the shaft holder 13 arranged in the fitting hole 12*a*. Thus, as seen along the width direction, the first coupling portion 10 is pivotable about the pivot pin P. Pivoting the first coupling portion 10 about the pivot pin P permits the first coupling portion 10 to be coupled or decoupled with respect to the second coupling portion 20.

Specifically, pivoting the first coupling portion 10 in a first direction D1 about the pivot pin P from the position where the first and second coupling portions 10 and 20 are coupled together (the position show in the upper diagram in FIG. 14) results in the first coupling portion 10 moving away from the second coupling portion 20. Pivoting the first coupling portion 10 in the first direction D1 achieves the state shown in the lower diagram in FIG. 14. In other words, the first and second coupling portions 10 and 20 are decoupled (disengaged) from each other. In yet other words, the coupling unit UC is separated from the folding unit 2.

Thus, the folding unit 2 can be removed from the apparatus body 1000 with the sub discharge unit 1 left in the apparatus body 1000. In other words, simply by pivoting the first coupling portion 10 about the pivot pin P, it is possible to remove the folding unit 2 from the apparatus body 1000. It is thus possible to facilitate the mounting and dismounting of the folding unit 2 with respect to the apparatus body 1000. This is convenient to a serviceperson who checks, replaces, or otherwise handles the folding unit 2 because only the folding unit 2 can be removed from the apparatus body 1000.

Figure 14:
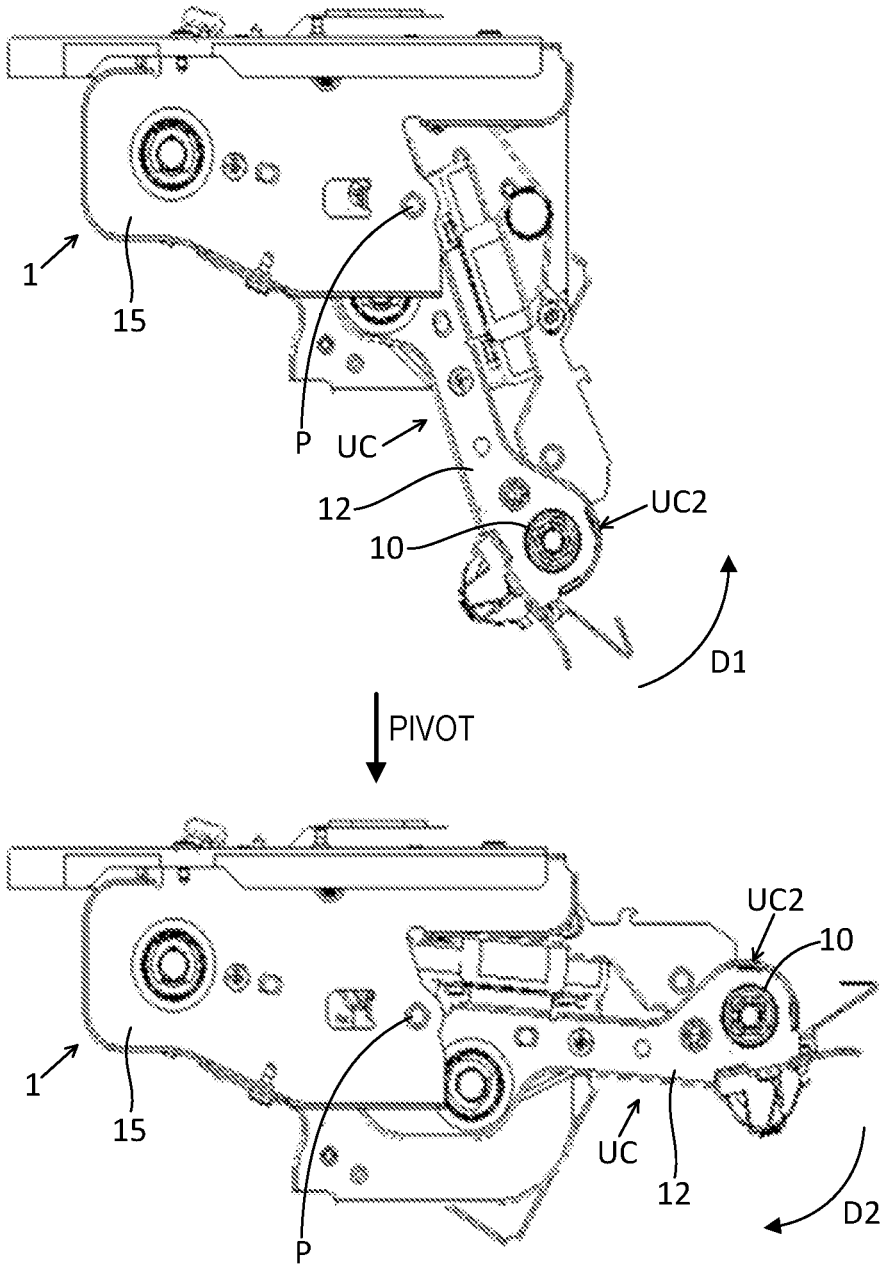
FIG. 14 is a diagram showing the positions, before and after rotation, of the coupling unit in the post-processing apparatus according to the embodiment.

From the state where the first and second coupling portions 10 and 20 are released from their mutual coupling (where the first coupling portion 10 is released from insertion in the coupling hole 201), that is, from the state shown in the lower diagram in FIG. 14, pivoting the first coupling portion 10 in a second direction D2 opposite from the first direction D1 about the pivot pin P results in the first coupling portion 10 moving closer to the second coupling portion 20. This achieves a return to the state shown in the upper diagram in FIG. 14. It is thus possible to couple the first and second coupling portions 10 and 20 together.

Figure 15:
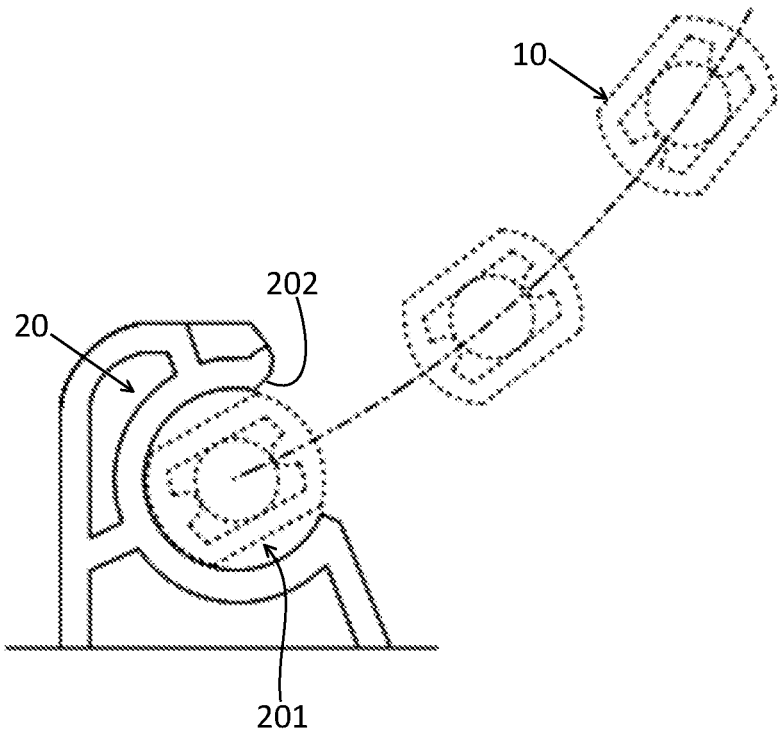
FIG. 15 is a diagram showing the pivoting path of the first coupling portion in the post-processing apparatus according to the embodiment.

Here, as seen along the width direction, the second coupling portion 20 has the communication port 202, which is an opening through which the spaces inside and outside the coupling hole 201 along the radial direction communicate with each other, on the pivoting path of the first coupling portion 10 (see FIG. 15). In other words, as seen along the width direction, the communication port 202 is open toward upstream with respect to the sheet conveyance direction. In FIG. 15, the pivoting path of the first coupling portion 10 is indicated by a dash-and-dot line, and the first coupling portion 10 in the process of pivoting is indicated by broken lines.

With this construction, the first coupling portion 10 can be inserted into the coupling hole 201 along the radial direction. In other words, from the state where the first and second coupling portions 10 and 20 are decoupled from each other, simply by pivoting the first coupling portion 10 in the second direction D2 about the pivot pin P permits the first and second coupling portions 10 and 20 to be coupled together. After the coupling-together of the first and second coupling portions 10 and 20, by rotating the first coupling portion 10 and holding it in the coupled position permits the folding unit 2 to be fixed to the sub discharge unit 1.

That is, when the folding unit 2 is mounted in the apparatus body 1000 in which the sub discharge unit 1 is mounted, first, with the other-end portion UC2 or the coupling unit UC swung upward, the folding unit 2 is arranged at a predetermined position in the apparatus body 1000, and then the other-end portion UC2 of the coupling unit UC is swung downward and the first coupling portion 10 is inserted into the coupling hole 201 through the communication port 202, so that the folding unit 2 is mounted in the apparatus body 1000.

Though not illustrated, for example, to hold the coupling unit UC in a state swung upward, a holding engagement portion that engages with the other-end portion UC2 of the coupling unit UC in that state is provided in the apparatus body 1000. With the other-end portion UC2 and the holding engagement portion engaged with each other, the coupling unit UC is held so as not to swing downward. There is no particular limitation on the structure of the member that holds the coupling unit UC in a state swung upward.

Thus, the mounting of the folding unit 2 in the apparatus body 1000 only involves arranging the folding unit 2 at a predetermined position in the apparatus body 1000 and then rotating the coupling unit UC followed by rotating the first coupling portion 10. This facilitates mounting and enhances the convenience to a serviceperson.

The embodiment disclosed herein is to be understood to be in every aspect illustrating and not restrictive. The scope of the present invention is defined not by the description of the embodiment given above by the appended claims, and encompasses any modifications in a scope equivalent in significance to that of the claims.

The invention claimed is:

1. A sheet conveying apparatus, comprising:

an apparatus body having a sheet reception port and a sheet discharge port;

a first unit mounted in the apparatus body, the first unit receiving a sheet conveyed from the sheet reception port and conveying the sheet downstream;

a second unit mounted in the apparatus body, downstream of the first unit with respect to a sheet conveyance direction, the second unit discharging the sheet from the sheet discharge port; and a coupling unit having a one-end portion pivoted on the second unit and an other-end portion swingable about a pivoted part of the one-end portion and decouplably coupled to the first unit, the coupling unit conveying the sheet from the first unit to the second unit, wherein the coupling unit includes:

a shaft rotatably arranged on the other-end portion;

a shaft holder supporting an end part of the shaft along an axial direction; and a shaft fitting plate having a fitting hole to which the shaft is fitted, the shaft holder includes:

a holder body rotatably supported in the fitting hole, the holder body being in a cylindrical shape; and a first coupling portion protruding from the holder body outward along the axial direction, the first unit includes a second coupling portion arranged outward of the shaft fitting plate along the axial direction, the first unit is mountable in the apparatus body along the horizontal direction from upstream of the second unit with respect to the sheet conveyance direction, and when the first unit is mounted in the apparatus body and coupled to the second unit, first, with the other-end portion swung upward, the first unit is mounted in the apparatus body and then, with the other-end portion swung downward, the first unit is coupled to the second unit.

2. The sheet conveying apparatus according to claim 1, wherein the first coupling portion is formed in an oval shape as seen along the axial direction so as to have a large-diameter portion and a small-diameter portion with a smaller width in a radial direction than the large-diameter portion, the second coupling portion has a coupling hole that faces the fitting hole along the axial direction and in which the first coupling portion is inserted, the coupling hole has a communication port through which, as seen along the axial direction, the small-diameter portion of the first coupling portion, which swings together with the other-end portion, can pass but the large-diameter portion cannot pass, and first the shaft holder is rotated inside the fitting hole to fix the first coupling portion at a first angle so that, in a state where the first coupling portion can pass through the communication port, the first coupling portion is inserted into the coupling hole through the communication port, and then the shaft holder is rotated inside the fitting hole to fix the first coupling portion at a second angle so that, in a state where the first coupling portion cannot pass through the communication port, the first and second units are coupled together.

3. The sheet conveying apparatus according to claim 2, wherein as seen along the axial direction, the communication port is open toward upstream with respect to the sheet conveyance direction, and when the first unit is mounted in the apparatus body and coupled to the second unit, first, with the other-end portion swung upward, the first unit is mounted in the apparatus body and then, with the other-end portion swung downward, the first coupling portion is inserted into the coupling hole through the communication port.

4. The sheet conveying apparatus according to claim 2, wherein the shaft holder has:

a brim portion formed at a one-end side of the holder body along the axial direction; and a locking segment extending from the brim portion to an other-end side of the holder body along the axial direction, the shaft fitting plate has a first engagement portion and a second engagement portion with one of which the locking segment is selectably engageable, and engaging the locking segment with the first engagement portion results in the first coupling portion being fixed at the first angle and engaging the locking segment with the second engagement portion results in the second coupling portion being fixed at the second angle.

5. The sheet conveying apparatus according to claim 4, wherein the locking segment is formed in a U-shape so as to have a first segment extending from the brim portion inward along the axial direction and a second segment bending back from the first segment to extend outward along the axial direction.

6. The sheet conveying apparatus according to claim 5, wherein the locking segment has a manipulation portion that bulges from a side edge of the second segment and that is holdable.

7. The sheet conveying apparatus according to claim 1, wherein the coupling unit includes a conveyance roller that is fitted to the shaft and that, by rotating, conveys the sheet, and the coupling unit, by making the conveyance roller rotate together with the shaft, conveys the sheet from the first unit to the second unit.

8. The sheet conveying apparatus according to claim 1, wherein the first unit is a unit that folds a sheet output from an image forming apparatus.

* * * * *